US010746496B2

(12) United States Patent
Nishihira

(10) Patent No.: US 10,746,496 B2
(45) Date of Patent: Aug. 18, 2020

(54) BOW

(71) Applicant: Ternarc Inc., Okayama-shi, Okayama (JP)

(72) Inventor: Morikazu Nishihira, Kurashiki (JP)

(73) Assignee: Ternarc Inc., Okayama-shi, Okayama (JP)

( * ) Notice: Subject to any disclaimer, the term of this patent is extended or adjusted under 35 U.S.C. 154(b) by 0 days.

(21) Appl. No.: 16/660,810

(22) Filed: Oct. 23, 2019

(65) Prior Publication Data

US 2020/0132409 A1 Apr. 30, 2020

(30) Foreign Application Priority Data

Oct. 29, 2018 (JP) ..... 2018-202653

(51) Int. Cl.
*F41B 5/00* (2006.01)
*F41B 5/10* (2006.01)
*F41B 5/14* (2006.01)

(52) U.S. Cl.
CPC ..... *F41B 5/105* (2013.01); *F41B 5/0094* (2013.01); *F41B 5/10* (2013.01); *F41B 5/143* (2013.01); *F41B 5/1426* (2013.01)

(58) Field of Classification Search
CPC ..... F41B 5/00; F41B 5/10; F41B 5/0094
See application file for complete search history.

(56) References Cited

U.S. PATENT DOCUMENTS 5,054,463 A * 10/1991 Colley ..... F41B 5/10 124/25.6
6,688,295 B1 2/2004 Miller
7,441,555 B1 10/2008 Larson
8,522,762 B2 * 9/2013 Trpkovski ..... F41B 5/123 124/25.6
9,395,141 B2 * 7/2016 Cummings ..... F41B 3/02
10,184,749 B2 * 1/2019 Trpkovski ..... F41B 5/066
2007/0101980 A1 * 5/2007 Sims ..... F41B 5/10 124/25.6

FOREIGN PATENT DOCUMENTS

JP S55-33507 A 3/1980

* cited by examiner

*Primary Examiner* — John A Ricci
(74) *Attorney, Agent, or Firm* — Yokoi & Co., U.S.A.; Toshiyuki Yokoi

(57) ABSTRACT

A bow includes: a bow body; a first string cam provided on one end of the bow body to be rotatable, one end of a string being fixed to the first string cam; a first small diameter cam rotated with the first string cam, one end of a cable being wound on the first small diameter cam; a first large diameter cam rotated with the first string cam, one end of a cable being wound on the first large diameter cam; a second string cam provided on the other end of the bow body to be rotatable, the other end of the string being fixed to the second string cam; a second small diameter cam rotated with the second string cam, the other end of the cable being wound on the second small diameter cam; and a second large diameter cam rotated with the second string cam, the other end of the cable being wound on the second large diameter cam.

5 Claims, 6 Drawing Sheets

Fig. 4A
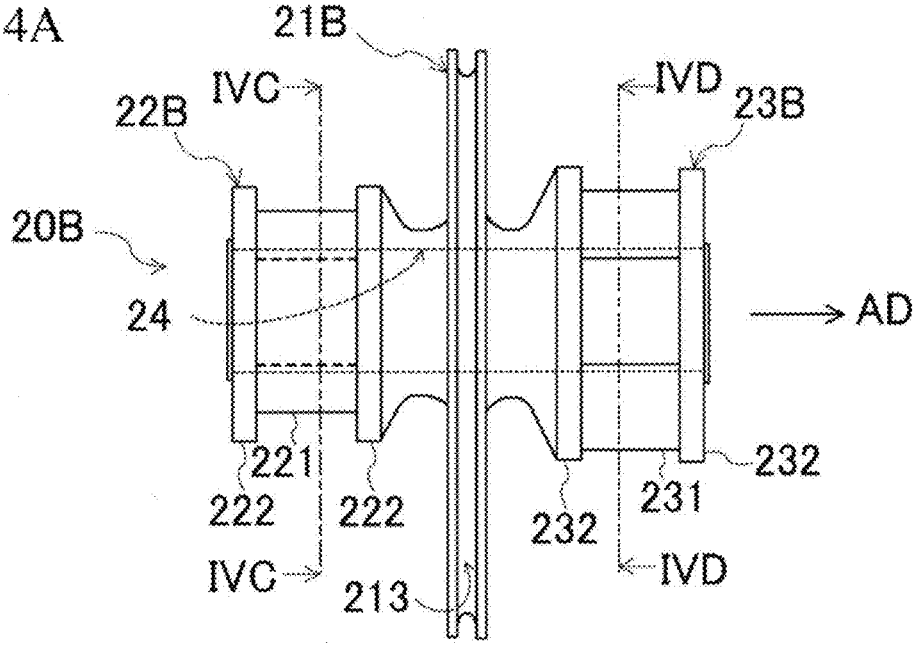
Fig. 4B
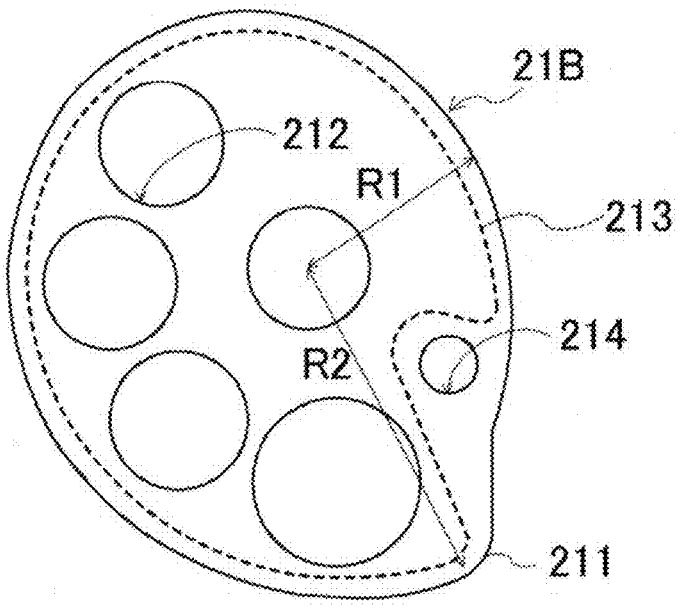
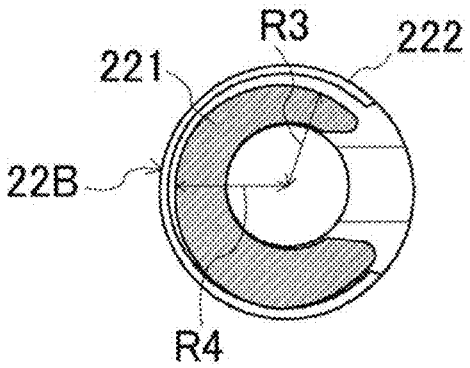
Fig. 4C
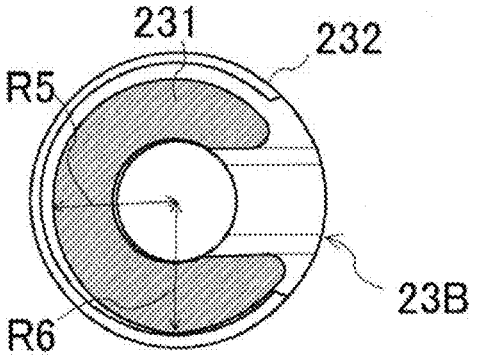
Fig. 4D

BOW

CROSS-REFERENCES TO RELATED APPLICATIONS

This patent specification is based on Japanese patent application, No. 2018-202653 filed on Oct. 29, 2018 in the Japan Patent Office, the entire contents of which are incorporated by reference herein.

BACKGROUND OF THE INVENTION

1. Field of the Invention

The present invention relates to a bow.

2. Description of Related Art

Conventionally, there is a kind of a bow called a compound bow in which cams are provided on the end portions of limbs. In the compound bow, a string is pulled to rotate the cams and the limbs are bent by a rotational force of the cam. Then, an arrow is shot by using an elastomeric force of the limbs. In the compound bow, a force required for bending the limbs is reduced by using the cams. Thus, a burden on an archer is reduced.

However, since the limbs should be bent in the compound bow, the burden on the archer is not always small. In order to further reduce the burden on the archer, an alternative bow has been developed to shoot the arrow by elastically deforming a cable instead of the limbs for using the elastomeric force of the cable.

For example, Patent Document 1 discloses a bow in which a small diameter pulley and a large diameter pulley connected with the small diameter pulley are provided on one end and the other end of a bow body. In the bow disclosed in Patent Document 1, a cable is fixed to the small diameter pulley of one end, and then the cable is wound from the small diameter pulley of one end to the large diameter pulley of the other end, from the large diameter pulley of the other end to the large diameter pulley of one end, and from the large diameter pulley of one end to the small diameter pulley of the other end. Then, the other end of the cable is fixed to the small diameter pulley of the other end.

In the bow disclosed in Patent Document 1, an arrow is fitted at a part (i.e., knocking point) where the cable is tensed between the large diameter pulley of one side and the large diameter pulley of the other side. The large diameter pulleys of one side and the other side are rotated when the archer pulls the cable at the above described knocking point. Consequently, the small diameter pulleys of one side and the other side, which are connected with the large diameter pulleys, are also rotated. At that time, since the diameters are different between the large diameter pulleys and the small diameter pulleys, the cable is pulled and elastically deformed at a portion tensed between the small diameter pulley of one end and the large diameter pulley of the other end and at a portion tensed between the large diameter pulley of one end and the small diameter pulley of the other end. As a result, the arrow is shot by the elastomeric force caused by the elastomeric deformation of the cable.

[Patent Document 1] Japanese Patent Application Laid-Open No. S55-33507

BRIEF SUMMARY OF THE INVENTION

In the bow disclosed in Patent Document 1, the small diameter pulley and the large diameter pulley of one end are arranged in this order with respect to the small diameter pulley and the large diameter pulley of the other side in the axial direction of the pulleys. Therefore, the cable crosses between the small diameter pulley of one end and the large diameter pulley of the other end and between the large diameter pulley of one end and the small diameter pulley of the other end. As a result, the replacement of the cable is not easy when the cable is deteriorated.

Furthermore, in the bow disclosed in Patent Document 1, the small diameter pulleys and the large diameter pulleys are both formed in a cylindrical shape, or the small diameter pulleys are formed in a disc-like cam shape and the large diameter pulleys are formed in a cylindrical shape having a column cross-section. Therefore, in the bow disclosed in Patent Document 1, a load of pulling the cable by the archer increases as the distance of pulling (hereafter also referred to as drawing) the cable by the archer increases. As a result, the archer should continue to pull the cable with the maximum load after the archer pulls the cable maximally (i.e., fully drawn state) until the archer releases the arrow. Consequently, the burden on the archer is large in the bow disclosed in Patent Document 1.

The present invention provides a bow capable of replacing a cable easily and reducing the burden on the archer during the drawing.

A bow of the present invention has: a bow body; a first string cam that is provided on one end of the bow body so as to be rotatable, one end of a string being fixed to the first string cam; a first small diameter cam that is rotated in conjunction with the first string cam, one end side of a first cable being wound on the first small diameter cam; a first large diameter cam that is rotated in conjunction with the first string cam, one end side of a second cable being wound on the first large diameter cam; a second string cam that is provided on the other end of the bow body so as to be rotatable, the other end of the string being fixed to the second string cam; a second small diameter cam that is rotated in conjunction with the second string cam, the other end side of the second cable being wound on the second small diameter cam; and a second large diameter cam that is rotated in conjunction with the second string cam, the other end side of the first cable being wound on the second large diameter cam.

A small diameter portion of the first small diameter cam and the second small diameter cam and a large diameter portion of the first large diameter cam and the second large diameter cam can be formed in a cylindrical shape continuing in a circumferential direction.

A grip having a connection pin can be further provided, a bearing for rotatably holding the connection pin can be inserted in the bow body and the bow body can have a long hole penetrating through a gravity center of the bow body.

The connection pin can be arranged on a center axis of an arrow when the arrow is knocked on the string.

By using the configuration of the present invention, the first small diameter cam and the second large diameter cam are rotated in conjunction with the first string cam and the second string cam respectively to elastically deform the first cable. Therefore, when the string is pulled to rotate the first string cam and the second string cam, the force of pulling the string can be converted into a greater force of elastically deforming the first cable. As a result, the burden on the archer is reduced.

In addition, when the second small diameter cam and the first large diameter cam are rotated in conjunction with the second string cam and the first string cam respectively, the second cable is elastically deformed. Thus, same as the case of the first small diameter cam and the second large diameter cam, the force of pulling the string can be converted into a greater force of elastically deforming the second cable. Furthermore, since the force of pulling the string is converted into not only the force of elastically deforming the first cable but also the force of elastically deforming the second cable, power conversion efficiency is high. As a result, the burden on the archer is reduced.

Furthermore, the first cable wound on the first small diameter cam and the second large diameter cam is separated from the second cable wound on the first large diameter cam and the second small diameter cam (i.e., not one cable). In addition, the first cable and the second cable are not integrated with the string. Consequently, the replacement is easy.

BRIEF DESCRIPTION OF THE DRAWINGS

FIG. 4A is a front view of the reel provided with the bow concerning an embodiment of the present invention. FIG. 4B is a side view of a string cam provided with the reel. FIG. 4C is a cross-sectional view cut along a line IVC-IVC in FIG. 4A. FIG. 4D is a cross-sectional view cut along a line IVD-IVD in FIG. 4A.

DETAILED DESCRIPTION OF THE INVENTION

Hereafter, the bow concerning the embodiments of the present invention will be explained in detail with reference to the drawings.

Note that the same reference sign is added to the same or similar configuration.

The bow concerning the embodiments of the present invention has reels on both ends. A string and cables are connected to each reel. In the above described bow, the reels are rotated by the string, and the cables are elastically deformed by the rotation of the reels. Thus, the arrow is shot by the elastomeric force of the cables.

First, the configuration of the bow will be explained with reference to FIG. 1 and FIG. 2. Then, the configuration of the components of the bow such as a reel and a cable will be explained with reference to FIG. 3 to FIG. 5. After that, usage and operation of the bow will be explained with reference to FIG. 1, FIG. 2, FIG. 5 and FIG. 6.

Note that the bow concerning the present embodiments is a bow for shooting the arrow in a state that the string is directed in a vertical direction. Therefore, up or down means the direction in a state of shooting the arrow. In addition, front or back means the direction when a shooting direction of the arrow is defined as the front. Left or right means the direction when the shooting direction is defined as the front.

Figure 1:
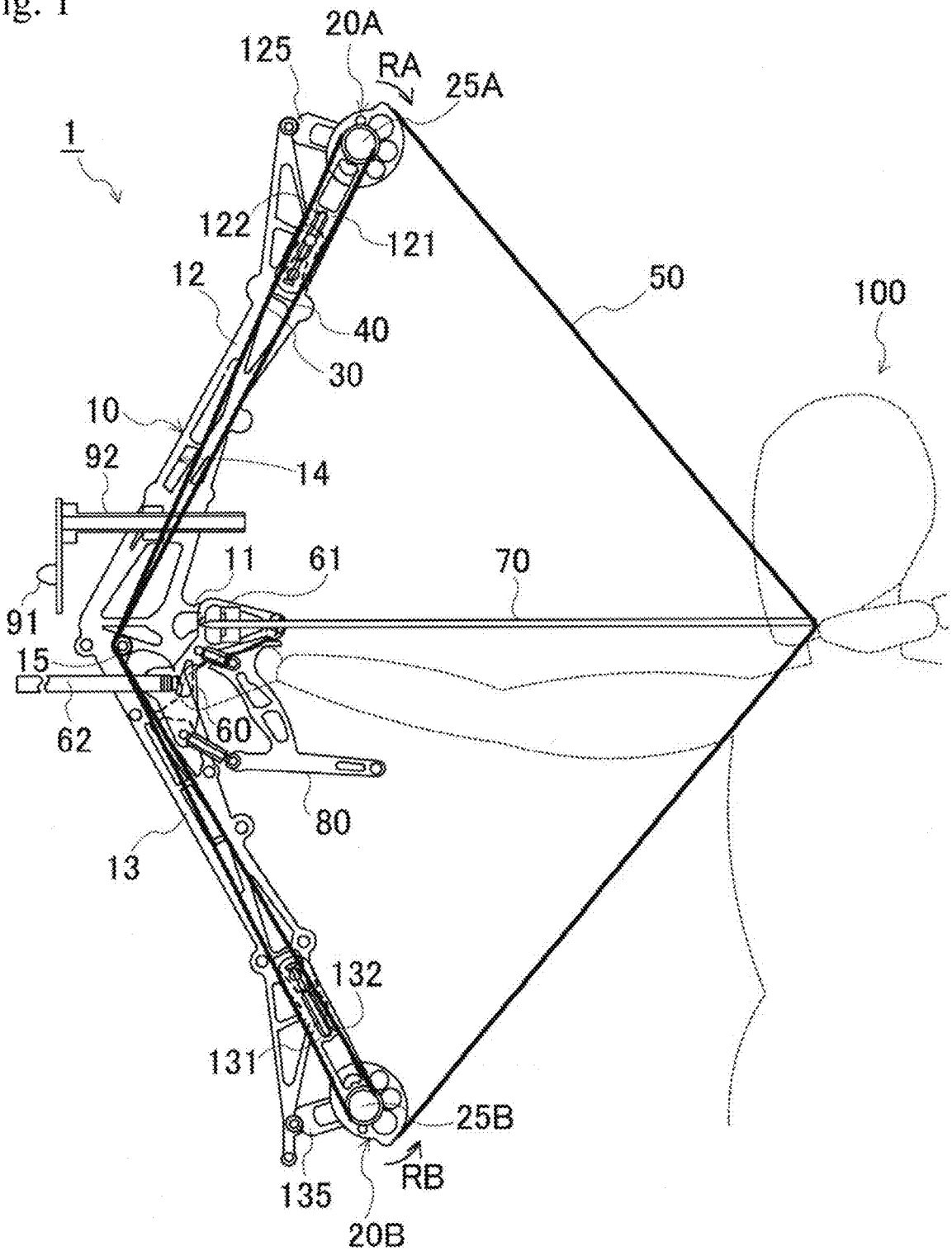
FIG. 1 is a side view of a bow concerning an embodiment of the present invention.

FIG. 1 is a side view of a bow 1 concerning an embodiment of the present invention. FIG. 2 is an enlarged side view of the center of the bow 1. Note that a bow body 10 is indicated by a thick line in FIG. 2 to facilitate understanding. Furthermore, a connection plate 60 is indicated by a dotted line. Furthermore, the connection plate 60 is indicated by reducing the size in FIG. 2 to displace the overlapped part between the connection plate 60 and the bow body 10 for facilitating understanding the positional relation. Furthermore, cables 30, 40 are omitted in FIG. 2.

As shown in FIG. 1, the bow 1 includes a bow body 10, reels 20A, 20B provided on the upper end and the lower end of the bow body 10 respectively, cables 30, 40 installed between the reels 20A, 20B, and a string 50 installed between the reels 20A, 20B. Here, in the specification of the present invention, the cables 30, 40 are also referred to as the first cable and the second cable respectively.

The bow body 10 is formed to have a portion protruded rearward from the center for holding an arrow 70 and a portion extended upward and downward from the center for installing the string 50. In detail, the bow body 10 has a protruded portion 11 protruded rearward from the center, a bow upper portion 12 extended obliquely upward from the center, and a bow lower portion 13 extended obliquely downward from the center. A plurality of hollow portions 14 is formed on the protruded portion 11, the bow upper portion 12 and the bow lower portion 13 for reducing the weight.

Note that the bow body 10 does not have the limb used in the compound bow. The limb is made of a metal material such as an aluminum alloy, a titanium alloy and a magnesium alloy. Therefore, the bow body 10 has higher rigidity than the limb and the bow body 10 is hardly deformed. The later described adjustment plates 121, 131 and support plates 125, 135 are also made of the above described metal material. Thus, they also have higher rigidity than the limb and they are hardly deformed.

Figure 2:
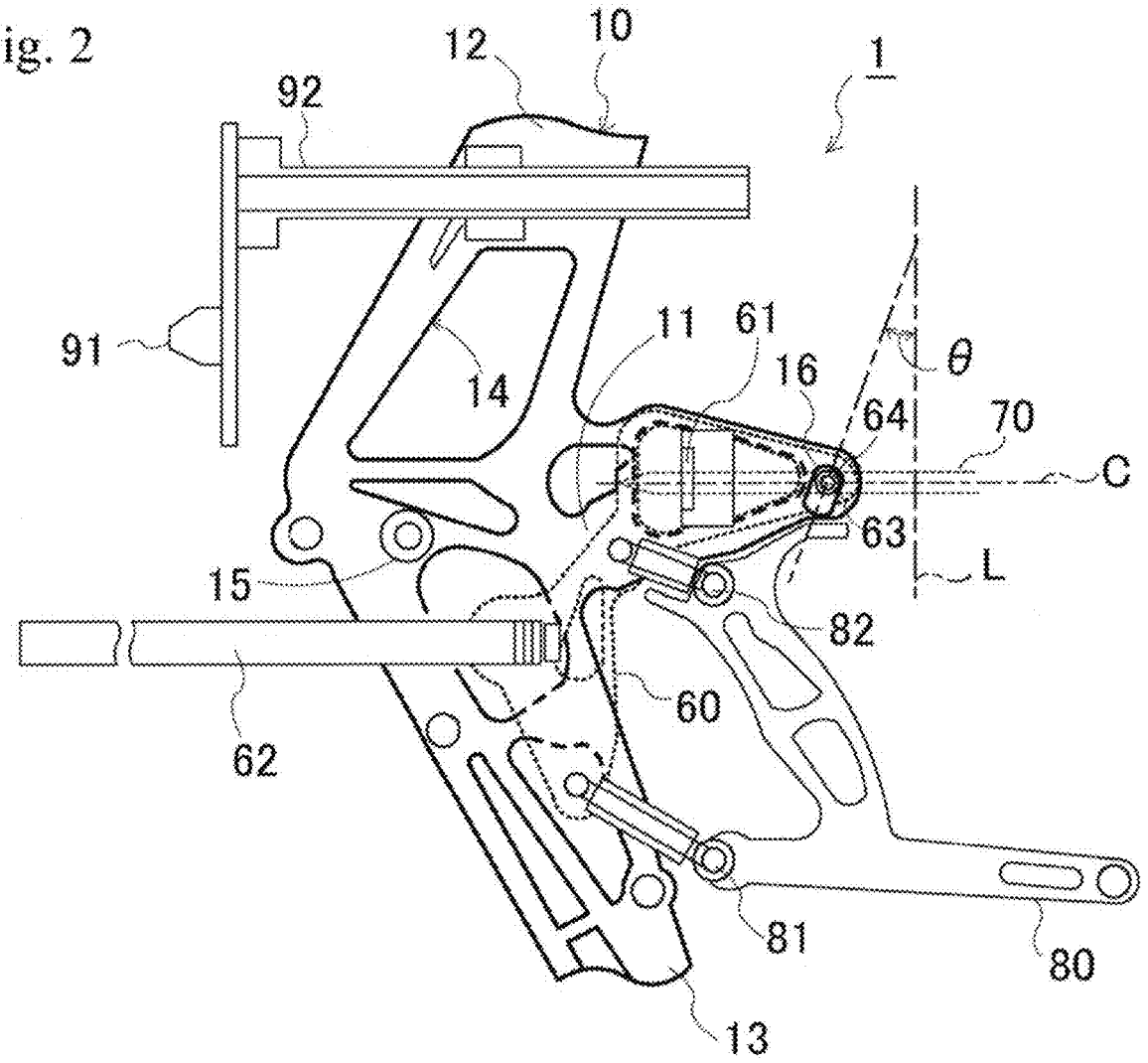
FIG. 2 is an enlarged side view of the center of the bow concerning an embodiment of the present invention.

As shown in FIG. 2, the connection plate 60 is overlapped with the protruded portion 11. In addition, a long hole 16 is formed on the protruded portion 11 for connecting the connection plate 60.

The connection plate 60 is provided to mount accessories of the bow 1. The accessories are, for example, a rest 61 for holding the arrow 70 and a stabilizer 62 for absorbing vibration and recoil when the arrow 70 is shot. In addition, a grip 80 is fixed to the connection plate 60. The connection plate 60 and the grip 80 are connected by ball joints 81, 82 for reducing the impact in the left and right directions when the arrow 70 is shot. Furthermore, a connection pin 63 is provided on the connection plate 60 so that the connection pin 63 is inserted into the long hole 16.

To facilitate holding the bow 1, the center axis of the connection pin 63 is formed on the position passing through a center axis C of the arrow 70 when the arrow 70 is placed on the rest 61 and fitted to the string 50. In addition, the center axis of the connection pin 63 is provided perpendicularly to a plate surface of the bow body 10. The connection pin 63 is extended from the above described position vertically to the plate surface. The connection pin 63 is fitted into a bearing 64. Furthermore, the bearing 64 is inserted into the long hole 16.

To facilitate holding the bow 1, the center of the long hole 16 is provided on a gravity center of the bow body 10 in a side view. The width of the short direction of the long hole 16 is slightly longer than the outer diameter of the bearing 64 so that the bearing 64 can be loosely inserted into the long hole 16. In addition, the long distance direction of the long hole 16 is sufficiently longer than the outer diameter of the bearing 64. Consequently, the long hole 16 enables the bearing 64 to be slidable for reducing the shock and vibration in the vertical direction when the arrow 70 is shot.

In addition, the longitudinal direction of the long hole 16 is inclined rearward with respect to a straight line L connecting a reel 20A located at the upper end of the bow body 10 with a reel 20B located at the lower end of the bow body 10. The angle θ of the inclination is approximately 10°. Consequently, the long hole 16 reduces the shock and vibration in a specific direction when the arrow 70 is shot.

As shown in FIG. 1, a pulley 15 is provided near a boundary between the bow upper portion 12 and the bow lower portion 13. The cables 30, 40 are wound at the front side of the pulley 15. Consequently, the cables 30, 40 are prevented from obstructing an archer 100.

A sight 92 is mounted on the bow upper portion 12 to fix a sight pin 91 on the sight 92. Here, the sight pin 91 is a pin to function as an aiming point when the archer 100 aims at a mark.

In addition, the bow upper portion 12 is extended obliquely upward from the center and then bent upward. Similarly, the bow lower portion 13 is extended obliquely downward from the center and then bent downward. Adjustment plates 121, 131 are provided on the bent part of the bow upper portion 12 and the bow lower portion 13 respectively to adjust the size of the bow body 10. In addition, support plates 125, 135 for holding the reels 20A, 20B are provided on the upper end of the bow upper portion 12 and the lower end of the bow lower portion 13 respectively.

The adjustment plates 121, 131 are formed in a rectangular shape. Long holes 122, 132 extending in the longitudinal direction are formed on the adjustment plates 121, 131 respectively. The positions of the adjustment plates 121, 131 are adjusted by inserting screws into an arbitrary position in the long holes 122, 132 and fixing the screws to the screw holes formed on the bow upper portion 12 and the bow lower portion 13. A rotary shaft 25A of the reel 20A and a rotary shaft 25B of the reel 20B are provided on the upper end of the adjustment plate 121 and the lower end of the adjustment plate 131 respectively.

Meanwhile, the support plates 125, 135 are formed in a rectangular shape. One end of the support plates 125, 135 in the longitudinal direction holds the rotary shafts 25A, 25B respectively. The other end of the support plates 125, 135 is fixed on the upper end of the bow upper portion 12 and the lower end of the bow lower portion 13 respectively by screws for holding the rotary shafts 25A, 25B by the bow body 10.

The rotary shafts 25A, 25B rotatably hold the reels 20A, 20B. As explained above, the cables 30, 40 and the string 50 are installed on the reels 20A, 20B. Since the rotary shafts 25A, 25B are held by the adjustment plates 121, 131 and the support plates 125, 135, the rotary shafts 25A, 25B are hardly distorted even when pulled by the cables 30, 40 and the string 50. In addition, the rotary shafts 25A, 25B are hardly displaced. Then, the configurations of the reels 20A, 20B, the cables 30, 40 and the string 50 will be explained with reference to FIG. 3 to FIG. 5.

Figure 3:
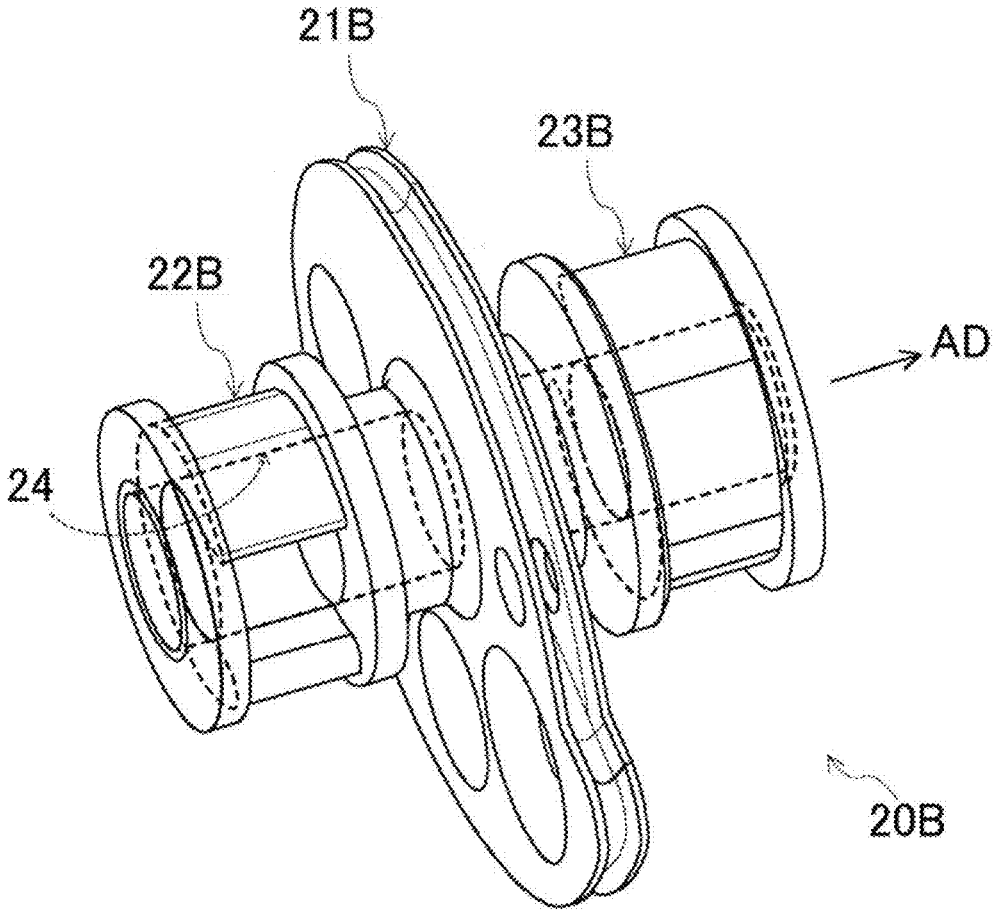
FIG. 3 is a perspective view of a reel provided with the bow concerning an embodiment of the present invention.
Figures 5A, 5B, 5C, 5D:
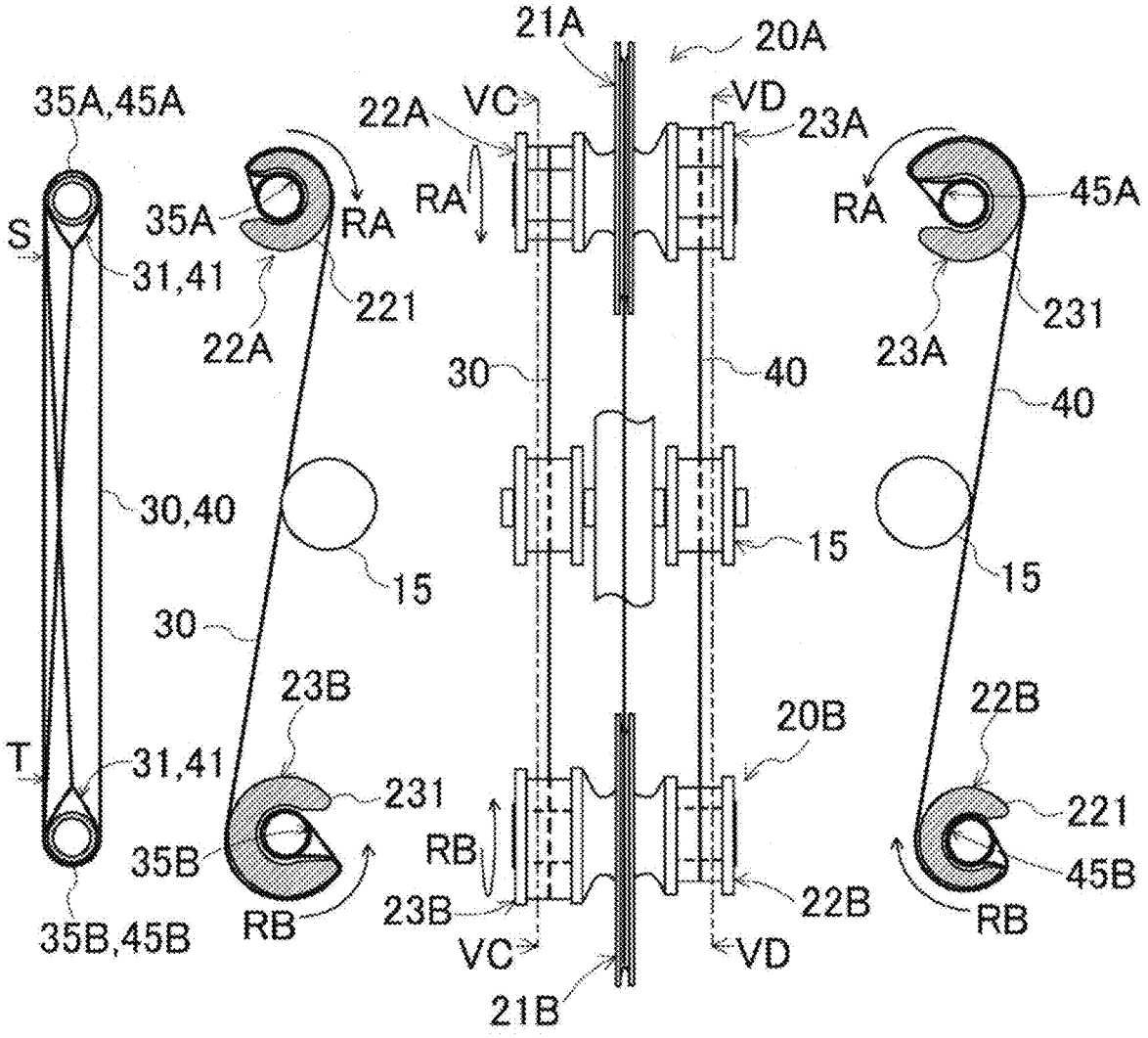
FIG. 5A is a cross-sectional view of bobbins used in the bow concerning an embodiment of the present invention.
FIG. 5B is a conceptual diagram of the reel on which the first cable, the second cable and the string of the bow are installed concerning an embodiment of the present invention.
FIG. 5C is a cross-sectional view cut along a line VC-VC in FIG. 5B.
FIG. 5D is a cross-sectional view cut along a line VD-VD in FIG. 5B.

FIG. 3 is a perspective view of the reel 20B provided with the bow 1 concerning an embodiment of the present invention. FIG. 4A is a front view of the reel 20B, and FIG. 4B is a side view of a string cam provided with the reel 20B. FIG. 4C is a cross-sectional view cut along a line IVC-IVC in FIG. 4A. FIG. 4D is a cross-sectional view cut along a line IVD-IVD in FIG. 4A. FIG. 5A is a cross-sectional view of bobbins 35A, 45A, 35B and 45B used in the bow 1. FIG. 5B is a conceptual diagram of the reels 20A, 20B on which the cables 30, 40 and the string 50 are installed. FIG. 5C is a cross-sectional view cut along a line VC-VC in FIG. 5B. FIG. 5D is a cross-sectional view cut along a line VD-VD in FIG. 5B.

Note that the configurations of the reels 20A, 20B are common except that the shapes are vertically and horizontally reversed with each other. Therefore, only the reel 20B is shown in FIG. 3 and FIGS. 4A-4D, and the illustration of the reel 20A is omitted. In addition, FIG. 5B shows a drawing of the reels 20A, 20B viewed from the rear surface. FIGS. 5B-5D show the state that the cables 30, 40 and the string 50 are linearly installed to facilitate understanding.

As shown in FIG. 3 and FIG. 4A, the reel 20B includes a string cam 21B which is provided on the center in an axial direction AD, and a small diameter cam 22B and a large diameter cam 23B which are arranged sandwiching the string cam 21B. The string cam 21B, the small diameter cam 22B and the large diameter cam 23B are coaxially arranged in the axial direction AD in the order of the small diameter cam 22B, the string cam 21B and the large diameter cam 23B, and integrated with each other. A through hole 24 is formed on the string cam 21B, the small diameter cam 22B and the large diameter cam 23B coaxially with them to insert the rotary shaft 25B into the through hole 24. The bow body 10 is arranged forward of the small diameter cams 22A, 22B and the large diameter cams 23A, 23B. As described above, the configurations of the reels 20A, 20B are common except that the shapes are vertically and horizontally reversed with each other. Therefore, only the configuration of the reel 20B will be explained in the following explanation and the explanation of the reel 20A is omitted. In the specification of the present invention, string cams 21A, 21B, small diameter cams 22A, 22B and large diameter cams 23A, 23B are also referred to as a first string cam, a second string cam, a first small diameter cam, a second small diameter cam, a first large diameter cam and a second large diameter cam respectively.

The string cam 21B is a cam rotated by pulling the string 50. An end portion of the string 50 is fixed to the string cam 21B. As shown in FIG. 4B, the string cam 21B is formed in a flattened circular plate shape having a protruded portion 211 (i.e., non-circular plate shape). A plurality of hollow portions 212 is formed on the string cam 21B for reducing the weight.

As shown in FIG. 4A and FIG. 4B, a groove 213 is formed on an outer peripheral portion of the string cam 21B to wound the string 50 in the groove 213. Meanwhile, as shown in FIG. 4B, a pin insertion hole 214 is formed on the side surface of the string cam 21B to penetrate through the string cam 21B so that center line of the pin insertion hole 214 crosses over the groove 213. Although it is not illustrated, a pin is inserted into the pin insertion hole 214. In the string cam 21B, the pin is inserted into the pin insertion hole 214 and the end portion of the string 50 is fixed to the pin in the groove 213. Then, the string 50 is wound along (around) the groove 213.

As explained above, the string cam 21B has a non-circular plate shape. In detail, the string cam 21B has a shape formed by connecting a small diameter portion having a radius R1 with a large diameter portion having a radius R2 which is larger than the radius R1 in a circumferential direction. Namely, the radius is different in the circumferential direction, and the curvature of the curve is different in the circumferential direction. Consequently, when the string 50 is pulled by the archer 100 and the string cam 21B is rotated, whole the reel 20B is rotated by the force corresponding to the rotation angle according to the principle of a lever. In other words, the string cam 21B adjusts the force that the archer 100 rotates the reel 20B by the string 50.

Meanwhile, the small diameter cam 22B is a cam on which the cable 30 is wound. The small diameter cam 22B is rotated together with the string cam 21B to further wind the wound cable 30 or untie/feed the cable 30. As shown in FIG. 4A and FIG. 4C, the small diameter cam 22B includes a cam portion 221 on which the cable 30 is wound, and two disc portions 222 arranged on both sides of the cam portion 221.

As shown in FIG. 4C, the cam portion 221 is formed in a tubular shape. A cavity is formed inside the cam portion 221 to house the cylindrical bobbin 35A on which the cable 30 is wound as shown in FIG. 5A. The cavity is opened to insert the bobbin 35A into the cavity. Although it is not illustrated, the rotary shaft 25B is inserted into the bobbin 35A in the cavity of the cam portion 221. Consequently, the bobbin 35A is fixed to the rotary shaft 25B and mounted on the cam portion 221.

As shown in FIG. 4C, the cam portion 221 is formed in a flattened circular shape in cross section (i.e., non-circular shape). In detail, the cam portion 221 has a cross-sectional shape formed by connecting a small diameter portion having a radius R3 with a large diameter portion having a radius R4 which is larger than the radius R3 in a circumferential direction. In other words, same as the string cam 21B, the radius of the cam portion 221 is different in the circumferential direction, and the curvature of the curve is different in the circumferential direction. Although it is not illustrated, the cable 30 extending from the bobbin 35A is wound on the cam portion 221. Since the cam portion 221 has the small diameter portion and the large diameter portion, when the cam portion 221 is rotated by the rotation movement of the string cam 21B, the winding amount or the feeding amount of the cable 30 varies according to the rotation angle. Consequently, the pulling amount or the lessening amount of the cable 30 is adjusted as described later.

The disc portion 222 is formed in a circular disk shape having an outer diameter larger than the outermost diameter of the cam portion 221. Consequently, the cable 30 is prevented from coming off from the cam portion 221.

Meanwhile, the large diameter cam 23B is a cam on which the cable 40 which is different from the cable 30 is wound. The large diameter cam 23B is rotated together with the string cam 21B to further wind the wound cable 40 or untie/feed the cable 40. As shown in FIG. 4A and FIG. 4D, the large diameter cam 23B has a larger diameter than the small diameter cam 22B. In detail, the large diameter cam 23B includes a cam portion 231 having a larger diameter than the cam portion 221 of the small diameter cam 22B, and a disc portion 232 having a larger diameter than both the cam portion 231 and the disc portion 222 of the small diameter cam 22B.

The configuration of cam portion 231 is same as the cam portion 221 of the small diameter cam 22B except that the diameter is larger than the cam portion 221, and the positions of providing the small diameter portion having a radius R5 and the large diameter portion having a radius R6 which is larger than the radius R5 are different. Therefore, the explanation of the cam portion 231 is omitted. In addition, the configuration of the disc portion 232 is same as the disc portion 222 of the small diameter cam 22B except that the diameter is larger than the disc portion 222. Therefore, the explanation of the disc portion 232 is omitted.

As shown in FIG. 1, the reel 20A is provided on the upper end of the bow body 10. The shape of the reel 20A is vertically and horizontally reversed with respect to the above described the reel 20B. The string 50 and the cables 30, 40 are installed between the reel 20A and the reel 20B.

The string 50 is a member for fitting (i.e., knocking) the arrow 70 at the string 50. The string 50 is formed by a thread made of durable materials such as polyamide and polyethylene. As shown in FIG. 1, the upper end of the string 50 is fixed to the string cam 21A located at the upper end of the bow body 10. The lower end of the string 50 is fixed to the string cam 21B located at the lower end of the bow body 10. Consequently, when the string 50 is pulled by the archer 100, the string cams 21A, 21B are rotated.

Meanwhile, the cables 30, 40 are members to rotate the reels 20A, 20B by the elastomeric force when the cables 30, 40 are elastically deformed. Thus, the arrow 70 knocked on the string 50 is shot. The cables 30, 40 are formed by a thread made of polyarylate fiber, aramid fiber, poly paraphenylene benzobisoxazole fiber or the like to increase the tensile strength. Since the cables 30, 40 are preferred to have high elastic energy when elastically deformed, the cables 30, 40 are formed by winding a thread multiple times in a circular manner and then bundling the thread.

In detail, as shown in FIG. 5A, rings 31, 41 are provided on the upper end and lower end of the cables 30, 40 respectively. The rings 31, 41 of the upper end side are inserted around the bobbins 35A, 45A. The cable 30 is wound from the bobbins 35A, 45A on which the rings 31, 41 are hooked to the bobbins 35B, 45B, and then wound on the bobbins 35A, 45A again. The cables 30, 40 are wound multiple times (e.g., 5 to 10 times). Then, the rings 31, 41 of the lower end side are inserted into the bobbins 35B, 45B. Although it is not illustrated, the cables 30, 40 are bundled at positions S, T near the bobbins 35A, 45A and the bobbins 35B, 45B respectively. Consequently, the cables 30, 40 are formed by the bundled threads.

Furthermore, the cables 30, 40 are installed on the reels 20A, 20B by mounting the above described bobbins 35A, 45A and bobbins 35B, 45B on the small diameter cam 22A, the large diameter cam 23A, the large diameter cam 23B and the small diameter cam 22B respectively.

In detail, as shown in FIG. 5C, the cable 30 is mounted on the small diameter cam 22A by housing the bobbin 35A of the upper end side in a cavity formed on the cam portion 221 of the small diameter cam 22A. The cable 30 is wound from the bobbin 35A of the upper end side to the cam portion 221 of the small diameter cam 22A, and then wound on the pulley 15. Furthermore, after wound on the pulley 15, the cable 30 is wound on the cam portion 231 of the large diameter cam 23B. Here, a winding direction wound to the cam portion 221 is a direction RA which is a rotational direction of the reel 20A when the later described string 50 is pulled rearward. In addition, a winding direction wound to the cam portion 231 is a direction RB which is opposite to the direction RA. Then, the bobbin 35B of the lower end side is housed in a cavity formed on the cam portion 231 of the large diameter cam 23B. Thus, the bobbin 35B is mounted on the large diameter cam 23B. Consequently, the cable 30 is installed between the reel 20A and the reel 20B. Since the cable 30 is wound on the cam portions 221, 231 having different diameters, when the small diameter cam 22A and the large diameter cam 23B are rotated at the same angle by the rotation movement of the string cams 21A, 21B, the cable 30 is pulled or loosened.

Meanwhile, the cable 40 is installed between the reel 20A and the reel 20B as shown in FIG. 5D same as the cable 30 except that the bobbin 45A of the upper end side is housed in the cavity formed on the cam portion 231 of the large diameter cam 23A, the bobbin 45B of the lower end side is housed in the cavity formed on the cam portion 221 of the small diameter cam 22B, and the winding direction of the cable 30 wound to the cam portion 231 and the cam portion 221 is opposite to the winding direction of the cable 30 wound to the cam portion 221 and the cam portion 231. Same as the cable 30, the cable 40 is also wound on the cam portions 231, 221 having different diameters. Thus, when the large diameter cam 23A and the small diameter cam 22B are rotated at the same angle by the rotation movement of the string cams 21A, 21B, the cable 40 is pulled or loosened.

As explained above, the cables 30, 40 are pulled or loosened by the rotation movement of the string cam 21A, 21B. In the bow 1, the arrow 70 is shoot by using the elastomeric force generated when the cables 30, 40 are pulled and elastically deformed.

Then, the operation of the bow 1 will be explained with reference to FIG. 1, FIG. 2, FIG. 5 and FIG. 6. The following explanation is based on the presumption that the archer 100 holds the grip 80 of the bow 1 and knocks the arrow 70 on a part of the string 50 to which the arrow 70 is fitted (i.e., knocking point).

Figure 6:
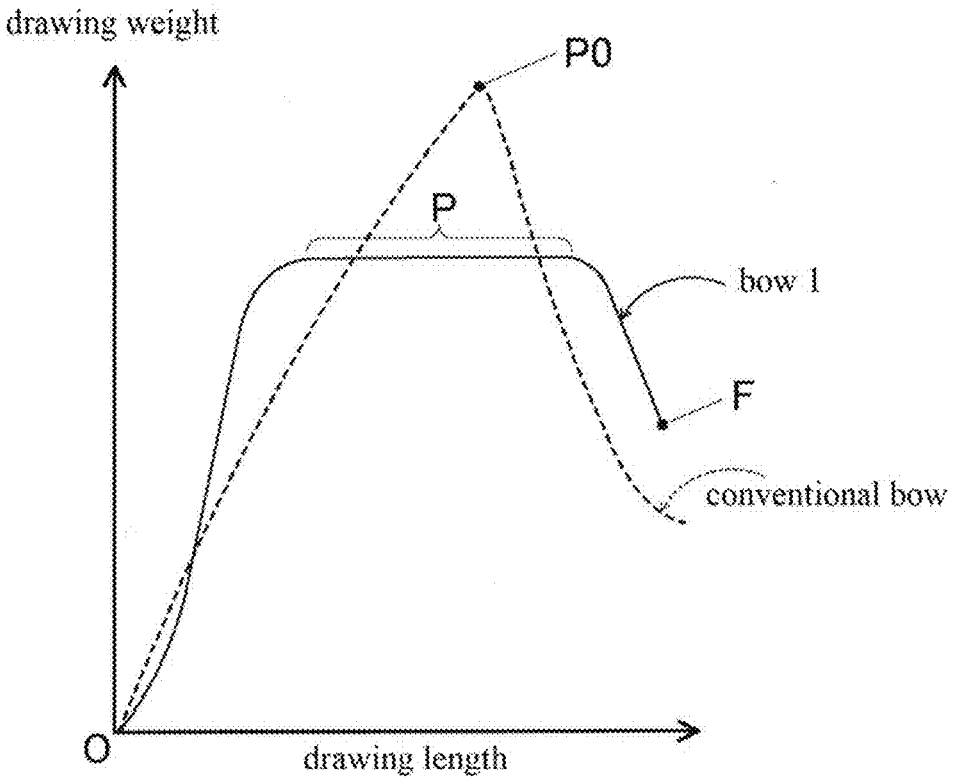
FIG. 6 is a graph showing a relation between a drawing length and a drawing weight of the bow concerning an embodiment of the present invention.
Figure 7:
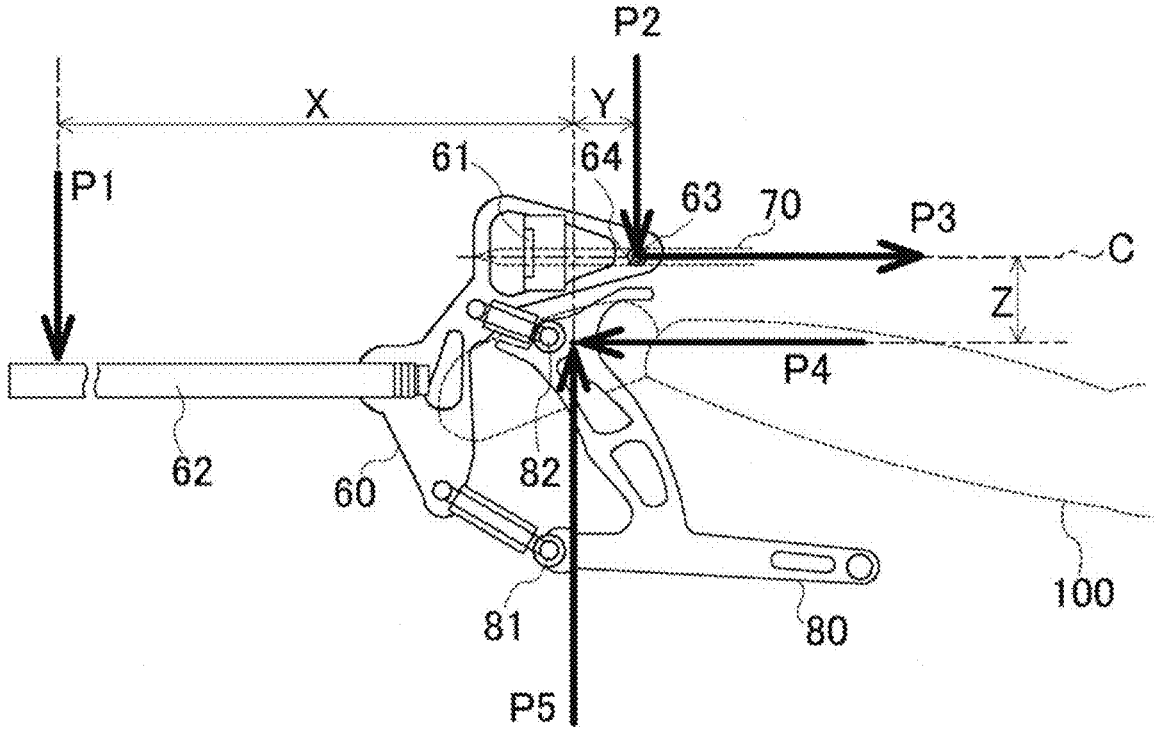
FIG. 7 is an enlarged side view of a connection plate of the bow when the bow is fully drawn concerning an embodiment of the present invention.

FIG. 6 is a graph showing a relation between a drawing length and a drawing weight of the bow 1 concerning an embodiment of the present invention. FIG. 7 is an enlarged side view of a connection plate 60 of the bow when the bow is fully drawn concerning an embodiment of the present invention. Here, the drawing length is a distance of pulling (i.e., drawing) the arrow 70 from the knocking point by the archer 100 The drawing weight is a force (expressed as a weight) required for drawing the arrow 70 in the above described state. Note that a graph showing a relation between a drawing length and a drawing weight of the conventional compound bow is also shown in FIG. 6. In the bow 1, kinetic energy added to the bow 1 by the archer 100 until the arrow 70 is released is stored as elastic energy of the cables 30, 40. In FIG. 6, the relation between the drawing length and the drawing weight of the conventional compound bow is illustrated when assuming that the kinetic energy added to the conventional compound bow by the archer 100 until the arrow 70 is released is same as kinetic energy added to the bow 1 in the embodiment.

First, the archer 100 draws the knocked arrow 70 as shown in FIG. 1. When the arrow 70 is drawn, the string 50 is pulled rearward. Consequently, the reel 20A is rotated in the direction RA as shown in FIG. 1. Furthermore, the reel 20B is rotated in the direction RB which is opposite to the direction RA.

At that time, the string cam 21A is rotated in the direction RA in the reel 20A. As shown in FIG. 5B and FIG. 5C, the small diameter cam 22A is also rotated in the direction RA since the small diameter cam 22A is integrated with the string cam 21A. The cable 30 is wound on (around) the small diameter cam 22A in the direction RA. Therefore, the cable 30 untied from the small diameter cam 22A and fed.

Meanwhile, in the reel 20B, the string cam 21B is rotated in the direction RB as shown in FIG. 5B. The large diameter cam 23B is also rotated in the direction RB since the large diameter cam 23B is integrated with the string cam 21B. In the large diameter cam 23B, the cable 30 is wound in an opposite direction of the direction RB. Therefore, the cable 30 is wound on (around) the large diameter cam 23B.

As explained above, the cable 30 is fed from the small diameter cam 22A and wound on the large diameter cam 23B. Since the diameter of the large diameter cam 23B is larger than the diameter of the small diameter cam 22A, the amount of winding the cable 30 by the large diameter cam 23B is larger than the amount of feeding the cable 30 by the small diameter cam 22A. Therefore, the cable 30 is pulled by the large diameter cam 23B. As a result, the cable 30 is elastically deformed.

As shown in FIG. 5D, the large diameter cam 23A is integrated with the string cam 21A in the reel 20A. Thus, when the string cam 21A is rotated in the direction RA, the large diameter cam 23A is also rotated in the direction RA. In the large diameter cam 23A, the cable 40 is wound in the opposite direction of the direction RA. Therefore, the cable 40 is wound on (around) the large diameter cam 23A.

Meanwhile, in the reel 20B, the small diameter cam 22B integrally formed with the string cam 21B is rotated in the direction RB. In the small diameter cam 22B, the cable 40 is wound on (around) the direction RB. Therefore, the cable 40 is untied from the small diameter cam 22B and fed.

As explained above, the cable 40 is wound on the large diameter cam 23A and fed from the small diameter cam 22B. Same as the case of the small diameter cam 22A and the large diameter cam 23B, the diameter of the large diameter cam 23A is larger than the diameter of the small diameter cam 22B, the amount of winding the cable 40 by the large diameter cam 23A is larger than the amount of feeding the cable 40 by the small diameter cam 22B. Therefore, the cable 40 is pulled by the large diameter cam 23A. As a result, the cable 40 is elastically deformed.

Then, when the archer 100 further draws the knocked arrow 70, the string cam 21A and the string cam 21B are further rotated. Therefore, the cables 30, 40 are further deformed. At that time, the small diameter portion and the large diameter portion of the cam portions 221, 231 are connected in the circumferential direction and the positions of the small diameter portion and the large diameter portion are different. Thus, when the small diameter cam 22A and the large diameter cam 23B are rotated, the elastic deformation amount of the cable 30 per the rotation angle varies according to the rotation angle of the small diameter cam 22A and the large diameter cam 23B. The rotation force required for elastically rotating the cable 30 also varies.

In addition, the small diameter portion and the large diameter portion of the string cams 21A, 21B are connected in the circumferential direction. Therefore, according to the principle of a lever, the force of rotating the small diameter cam 22A and the large diameter cam 23B varies depending on the rotation angle of the string cams 21A, 21B. As a result, the relation between the pulling length (i.e., drawing length) pulling the string 50 rearward and the pulling weight (i.e., drawing weight) for pulling the string 50 rearward by the archer 100 for elastically deforming the cable 30. The above described relation is the same in the cable 40.

In the bow 1, the shapes of the string cams 21A, 21B, the small diameter cams 22A, 22B and the large diameter cams 23A, 23B are preliminarily determined by an experiment to have the relation between the drawing length and the drawing weight shown in FIG. 6. In detail, as shown in FIG. 6, the shapes of the above described cams are formed so that the drawing weight is kept to the maximum peak weight P when the drawing length of pulling the string 50 rearward by the archer 100 exceeds a predetermined value, and the drawing weight becomes lower than the peak weight P when the drawing length is further increased approximately to a fully drawn state F.

As shown in FIG. 5C, when the archer 100 starts to draw the string 50, the small diameter cam 22A is rotated in the direction RA. When the radius of the part from which the cable 30 is released from the small diameter cam 22A is compared before and after the rotation, the radius is gradually reduced as the small diameter cam 22A rotates more. Namely, the length of the cable 30 released from the small diameter cam 22A is gradually reduced as the small diameter cam 22A rotates more. Similarly, when the radius of the part from which the cable 30 is released from the large diameter cam 23B is compared before and after the rotation, the radius is gradually reduced as the large diameter cam 23B rotates more. Namely, the length of the cable 30 wound on the large diameter cam 23B is gradually reduced as the large diameter cam 23B rotates more. Although the length of the cable 30 released from the small diameter cam 22A and the length of the cable 30 wound on the large diameter cam 23B are both become shorter, because of the difference of the radius between the small diameter cam 22A and the large diameter cam 23B, the cable 30 is gradually extended and the drawing weight is generated by the reaction force. The relation between the length of extending the cable 30 and the drawing weight is approximately proportional. However, in the above described example, since the relation between the rotation angle and the length of extending the cable 30 is not proportional, the increase rate of the drawing weight gradually reduces when the drawing length increases. The above described relation is same in the cable 40 shown in FIG. 5D.

Meanwhile, referring to FIG. 1 which shows the fully drawn state, the portion from which the string 50 is released from the string cams 21A, 21B is focused. In the fully drawn state, the portion from which the string 50 is released from the string cams 21A, 21B is a portion where the radius of the string cams 21A, 21B is the maximum. In other words, the radius of the portion from which the string 50 is released from the string cams 21A, 21B is the minimum before starting the drawing, and the radius gradually increased as the arrow 70 is drawn. As the arrow 70 is drawn, the string 50 is released from the string cams 21A, 21B. Thus, as the arrow 70 is drawn, the length of releasing tends to increase. Namely, the rotation angles of the small diameter cams 22A, 22B and the large diameter cams 23A, 23B tend to become smaller as the arrow 70 is drawn. When the drawing length increases, the increase rate of the drawing weight tends to become gradually lower. Normally, the relation between the drawing length and the drawing weight is approximately proportional. However, from the above described relation between the string cams 21A, 21B and the small diameter cams 22A, 22B and the relation between the string cams 21A, 21B and the large diameter cams 23A, 23B, the drawing weight can be kept to the peak weight P as shown in FIG. 6.

Therefore, the archer 100 draws the arrow 70 by a predetermined weight almost all the time after the weight reaches the peak weight P until near the fully drawn state F. As a result, the arrow 70 can be stably drawn in the bow 1 by keeping the peak weight P which is smaller than a peak weight P0 of the conventional compound bow. In addition, the decrease of the drawing weight near the fully drawn state F is smaller than the conventional compound bow. Thus, the archer 100 shifts from the peak weight P to the fully drawn state F while setting the target. As a result, the archer 100 draws the arrow 70 while keeping small burden.

Then, after the archer 100 fully draws the arrow 70, the arrow 70 is released. When the arrow 70 is released, the string 50 is shifted from the pulled state to the released state, and the string cams 21A, 21B are also shifted to the released state. As a result, the small diameter cams 22A, 22B and the large diameter cams 23A, 23B are also shifted to the released state. Consequently, the elastically deformed cables 30, 40 are restored to the original state, and the small diameter cams 22A, 22B and the large diameter cams 23A, 23B are rotated by the restoring force. As a result, the string cams 21A, 21B are rotated, the string 50 is returned to the original state from the rearwardly pulled state, and the arrow 70 is pushed forward.

Meanwhile, the gravitational force caused mainly by the stabilizer 62 of the connection plate 60 is defined as P1, the gravitational force of the bow body 10 is defined as P2, the reaction force of the drawing weight when the archer 100 fully draws the arrow 70 (i.e., the drawing weight of the fully drawn state F shown in FIG. 6) is defined as P3, the drawing weight applied by the archer 100 is defined as P4, and the force of holding the bow 1 by the archer 100 is defined as P5 in the fully drawn state F shown in FIG. 7, the above described forces satisfy the following expressions 1 to 3.

$$P1+P2=P5 \quad \text{(Expression 1)}$$

$$P1\times X=P2\times Y+P3\times Z \quad \text{(Expression 2)}$$

$$P3=P4 \quad \text{(Expression 3)}$$

However, when the arrow 70 is released, the drawing length becomes smaller. Thus, as apparently shown in FIG. 6, the force P4 of the drawing weight changes. The balance of the moment shown in the expression (2) is collapsed by the above described change of the force P4 of the drawing weight. As shown in FIG. 6, although the change of the drawing weight is smaller than the conventional compound bow, the drawing weight is increased once from the fully drawn state F to the peak weight P. As a result, since the balance of the moment is collapsed, the impact is applied to the connection plate 60 for moving the connection plate 60 itself downward. In the fully drawn state F, the connection pin 63 and the bearing 64 are located on the upper end of the long hole 16 for supporting the bow body 10. When the impact is applied to the connection pin 63 and the bearing 64, the connection pin 63 and the bearing 64 are slid downward while contacting with the inner wall of the longitudinal direction of the long hole 16 to absorb the impact. After that, when the drawing weight is reduced from the peak weight P to an origin point O, the connection pin 63 and the bearing 64 are slid upward in the long hole 16 to absorb the impact. As explained above, the connection pin 63 and the bearing 64 are slid while guided by the long hole 16 to absorb the impact and vibration when the balance of the moment is collapsed. As a result, the impact and vibration are hardly transmitted to the rest 61. Consequently, the arrow 70 is pushed forward in a stable condition.

In addition, as described above, the peak weight P is almost always constant in the drawing length. Therefore, the hand of the archer 100 is hardly moved after the release until the arrow 70 is shot completely. Thus, the arrow 70 is pushed forward without deviation. As a result, the hit rate of hitting the target by the arrow 70 is improved compared to the conventional compound bow.

As explained above, in the bow 1 of the embodiment of the present invention, the small diameter cam 22A is rotated in conjunction with the string cam 21A to which one end of the string 50 is fixed. In addition, the large diameter cam 23B is rotated in conjunction with the string cam 21B to which the other end of the string 50 is fixed. Furthermore, the cable 30 is wound on the small diameter cam 22A and the large diameter cam 23B. Therefore, in the bow 1, the string cams 21A, 21B are rotated by pulling the string 50 and the small diameter cam 22A and the large diameter cam 23B can be also rotated. As a result, the cable 30 are elastically deformable.

In addition, the large diameter cam 23A is rotated in conjunction with the string cam 21A. The small diameter cam 22B is rotated in conjunction with the string cam 21B. Furthermore, the cable 40 is wound on the large diameter cam 23A and the small diameter cam 22B. Therefore, same as the small diameter cam 22A and the large diameter cam 23B, the large diameter cam 23A and the small diameter cam 22B can be rotated by pulling the string 50. As a result, the cable 40 are elastically deformable. In the bow 1, the cable 40 can be also elastically deformed in addition to the cable 30. Therefore, the force of pulling the string 50 can be converted into the elastic deformation of the cables 30, 40 efficiently in the bow 1. Thus, the burden of the archer 100 is small during the drawing.

Since the small diameter cams 22A, 22B and the large diameter cams 23A, 23B are non-circular shaped cams (i.e., the small diameter portion and the large diameter portion are continuing in the circumferential direction), the cables 30, 40 can be deformed elastically by the force depending on the diameter of the cams. As a result, the force of pulling the string 50 can be converted into the elastic energy of the cables 30, 40 efficiently. Also in the string cams 21A, 21B, the small diameter portion and the large diameter portion are continuing in the circumferential direction. Therefore, the force of pulling the string 50 can be converted into the rotations of the small diameter cams 22A, 22B and the large diameter cams 23A, 23B by the conversion rate depending on the diameter of the cams. As a result, the force of pulling the string 50 can be converted into the rotations of the small diameter cams 22A, 22B and the large diameter cams 23A, 23B efficiently. Consequently, the burden of the archer 100 can be further reduced in the bow 1.

In addition, the cables 30, 40 are elastically deformed instead of one cable in the bow 1. Furthermore, the cables 30, 40 are not integrated with the string 50. Therefore, the cables 30, 40 which are more easily deformed than the string 50 can be used. Thus, the efficiency can be further increased. In addition, it is enough to replace only the cables 30, 40 which is separately provided with the string 50. Thus, the replacement is easy. As a result, maintainability is high in the bow 1.

The embodiments of the present invention are explained above. However, the present invention is not limited to the above described embodiments. Although the arrow 70 is shot by the bow 1 while aligning the string 50 in the vertical direction in the above described embodiments, the present invention is not limited to such a configuration. In the present invention, the arrow 70 can be shot while aligning the string 50 in a horizontal direction. In the above described case, the upper end of the bow body 10 on which the reel 20A is provided can be referred to as one end of the bow body 10, and the lower end of the bow body 10 on which the reel 20B is provided can be referred to as the other end of the bow body 10. Needless to say, also in the bow 1 which aligns the string 50 in the vertical direction, the upper end of the bow body 10 can be referred to as one end and the lower end the bow body 10 can be referred to as the other end.

In the above described embodiments, the member having the string cam 21A, the small diameter cam 22A and the large diameter cam 23A is referred to as the reel 20A and the member having the string cam 21B, the small diameter cam 22B and the large diameter cam 23B is referred to as the reel 20B. However, since the reels 20A, 20B have the string cam 21A, the small diameter cam 22A and the large diameter cam 23A, the reels 20A, 20B can be referred to merely as a cam member. In addition, since the cables 30, 40 are wound on the reels 20A, 20B, the reels 20A, 20B can be referred to as a pulley. In the present invention, it is enough to provide the string cam 21A, the small diameter cam 22A and the large diameter cam 23A on one end of the bow body 10 and the string cam 21B, the small diameter cam 22B and the large diameter cam 23B are provided on the other end of the bow body 10.

In the above described embodiments, the string cam 21A, the small diameter cam 22A and the large diameter cam 23A are integrally formed, and the string cam 21B, the small diameter cam 22B and the large diameter cam 23B are integrally formed. However, it is optional to form the cams integrally or separately. In the present invention, it is enough to rotate the string cam 21A, the small diameter cam 22A and the large diameter cam 23A interlockingly (integrally). In addition, it is enough to rotate the string cam 21B, the small diameter cam 22B and the large diameter cam 23B interlockingly.

In the above described embodiments, the cables 30, 40 are wound on the bobbins 35A, 35B, 45A and 45B. The bobbins 35A, 35B are mounted on the small diameter cam 22A and the large diameter cam 23B respectively. In addition, the bobbins 45A, 45B are mounted on the large diameter cam 23A and the small diameter cam 22B respectively. However, the method of mounting the cables 30, 40 on the small diameter cam 22A, the large diameter cam 23B, the large diameter cam 23A and the small diameter cam 22B are not limited as long as they are wound on the cams. Therefore, the cables 30, 40 can be wound on the cams without using the bobbins 35A, 35B, 45A and 45B. In the above described case, the upper end and the lower end of the cables 30, 40 are preferably fixed to the cams to prevent the cables 30, 40 from coming off when the cables 30, 40 are pulled.

In addition, the number and the material of the cables 30, 40 are not limited. For example, the cables 30, 40 can be formed by a plurality of threads. In the above described case, the plurality of threads can be wound on the bobbins 35A, 35B or the bobbins 45A, 45B as explained in the embodiments. In addition, the plurality of threads can be formed by bundling different kinds of fibers. A part of the plurality of threads can be formed of the fiber different from other threads.

In the above described embodiments, the connection pin 63 is fitted into the bearing 64. However, the configuration of providing the bearing 64 is optional. In the present invention, it is preferred that the bearing 64 rotatably holding the connection pin 63 for reducing the impact when the arrow 70 is shot. Consequently, the impact of the rotation of the bow body 10 with respect to the grip 80 provided on the connection plate 60 can be reduced. In the above described case, the bearing 64 is preferably in contact with the inner wall of the long hole 16 so as to be smoothly slidable.

In the above described embodiments, the bearing 64 is inserted into the long hole 16. However, the configuration of providing the long hole 16 is optional. In the present invention, the bow body 10 preferably have the long hole 16 into which the connection pin 63 is inserted for reducing the impact when the arrow 70 is shot. In the above described case, it is preferred that the connection pin 63 to which the bearing 64 is fitted is inserted into the long hole 16. Consequently, the connection pin 63 or the bearing 64 is slid in the longitudinal direction of the long hole 16 for reducing the impact when the arrow 70 is shot.

In addition, when the bow body 10 has the long hole 16, the long hole 16 preferably penetrates through a gravity center of the bow body 10. Here, the gravity center of the bow body 10 means a gravity center viewed from a direction perpendicular to the shooting direction of the arrow 70 and the extension direction of the string 50 (i.e., a gravity center in a side view of the bow 1 of the embodiments). Consequently, the weight of the bow 1 can be balanced. Furthermore, the center axis of the long hole 16 is preferably arranged on the center axis C of the arrow 70 when the arrow 70 is knocked on the string 50. The center axis of the long hole 16 is preferably provided coaxially with the center axis of the connection pin 63 or the bearing 64. In the above described embodiment, it is easy to keep a balance of the force when the archer 100 pulls the string 50 by the drawing weight.

In the above described embodiments, the long hole 16 is inclined approximately 10° rearward. However, the angle θ of the inclination is not particularly limited. When the bow body 10 has the long hole 16, the angle θ of the long hole 16 can be specifically determined from the above described relation between the drawing weight and the peak weight P in the fully drawn state F. For example, the angle θ can be specified to 0° for reducing the impact and vibration in the vertical direction when the arrow 70 is shot. Namely, the longitudinal direction of the long hole 16 can be extended in the vertical direction.

In the above described embodiments, the connection pin 63 is inserted into the long hole 16 inclined rearward for preventing the variation of the shooting direction when the arrow 70 is shot. The above described configuration of the long hole 16 and the connection pin 63 can be also applied to other embodiments than the bow 1. For example, it can be applied to the conventional bow shown in FIG. 6. In addition, it can be also applied to shooting devices (e.g., gun) for shooting an object generating recoil. In the above described case, from the relation between the drawing length and the drawing weight shown in FIG. 6, the configuration is preferably applied to the case where the recoil of the shooting varies, similar to the force applied to the grip 80 when shooting.

Although the adjustment plates 121, 131 and the support plates 125, 135 are provided on the bow body 10 for providing the reels 20A, 20B in the above described embodiments, it is optional whether or not to provide the adjustment plates 121, 131 and the support plates 125, 135. For example, the reels 20A, 20B can be provided directly on the bow body 10.

DESCRIPTION OF THE REFERENCE NUMERALS

1: bow
10: bow body
11: protruded portion
12: bow upper portion
13: bow lower portion
14: hollow portion
15: pulley
16: long hole
20A, 20B: reel
21A, 21B: string cam
22A, 22B: small diameter cam
23A, 23B: large diameter cam
24: through hole
25A, 25B: rotary shaft
30, 40: cable
31, 41: ring
35A, 35B, 45A, 45B: bobbin
50: string
60: connection plate
61: rest
62: stabilizer
63: connection pin
64: bearing
70: arrow
80: grip
81, 82: ball joint
91: sight pin
92: sight
100: archer
121, 131: adjustment plate
122, 132: long hole
125, 135: support plate
211: protruded portion
212: hollow portion
213: groove
214: pin insertion hole
221: cam portion
222: disc portion
231: cam portion
232: disc portion
AD: axial direction
C: center axis
F: fully drawn state
L: straight line
O: origin point
P, P0: peak weight
R1-R6: radius
RA, RB: direction
S, T: position
θ: angle

What is claimed is:

1. A bow, comprising:

a bow body without having a limb;

a first string cam that is provided on one end of the bow body so as to be rotatable, one end of a string being fixed to the first string cam;

a first small diameter cam that is rotated in conjunction with the first string cam, one end side of a first cable being wound on the first small diameter cam;

a first large diameter cam that is rotated in conjunction with the first string cam, one end side of a second cable being wound on the first large diameter cam;

a second string cam that is provided on the other end of the bow body so as to be rotatable, the other end of the string being fixed to the second string cam;

a second small diameter cam that is rotated in conjunction with the second string cam, the other end side of the second cable being wound on the second small diameter cam; and a second large diameter cam that is rotated in conjunction with the second string cam, the other end side of the first cable being wound on the second large diameter cam, wherein the first cable and the second cable are elastically deformable, the first cable and the second cable are deformed when a string is pulled, the first string cam and the second string cam are rotated, and the first small diameter cam, the second large diameter cam, the first large diameter cam and the second small diameter cam are rotated in conjunction with the first string cam and the second string cam, and the first small diameter cam, the second large diameter cam, the first large diameter cam and the second small diameter cam are rotated and the first string cam and the second string cam are rotated when the string is released to shoot an arrow knocked on the string by an elastomeric force generated when the first cable and the second cable are elastically deformed.

2. The bow according to claim 1, wherein the bow body is arranged forward of the first small diameter cam, the first large diameter cam, the second small diameter cam and the second large diameter cam, and the bow body has a pulley on which the first cable and the second cable are wound.

3. The bow according to claim 1, further comprising:

a first shaft provided on one end of the bow body for rotatably supporting the first string cam, the first small diameter cam and the first large diameter cam, a second shaft provided on the other end of the bow body for rotatably supporting the second string cam, the second small diameter cam and the second large diameter cam, a first bobbin housed in a first cavity formed in the first small diameter cam, the first shaft being inserted into the first bobbin, a second bobbin housed in a second cavity formed in the second large diameter cam, the second shaft being inserted into the second bobbin, a third bobbin housed in a third cavity formed in the first large diameter cam, the first shaft being inserted into the third bobbin, and a fourth bobbin housed in a fourth cavity formed in the second small diameter cam, the second shaft being inserted into the fourth bobbin, wherein the first cable is wound on the first bobbin and the second bobbin multiple times, and the second cable is wound on the third bobbin and the fourth bobbin multiple times.

4. The bow according to claim 1, further comprising:

a grip having a connection pin, wherein a bearing for rotatably holding the connection pin is inserted in the bow body, and the bow body has a long hole penetrating through a gravity center of the bow body.

5. The bow according to claim 4, wherein the connection pin is arranged on a center axis of an arrow when the arrow is knocked on the string.

* * * * *